US012435885B2

(12) United States Patent
Li et al.

(10) Patent No.: US 12,435,885 B2
(45) Date of Patent: Oct. 7, 2025

(54) AIR CONDITIONER OUTDOOR UNIT AND AIR CONDITIONER

(71) Applicants: HEFEI MIDEA HEATING & VENTILATING EQUIPMENT CO., LTD., Anhui (CN); GD MIDEA HEATING & VENTILATING EQUIPMENT CO., LTD., Guangdong (CN)

(72) Inventors: Yang Li, Anhui (CN); Yonghua Zhong, Anhui (CN); Zhanglong Huang, Anhui (CN)

(73) Assignees: HEFEI MIDEA HEATING & VENTILATING EQUIPMENT CO., LTD., Anhui (CN); GD MIDEA HEATING & VENTILATING EQUIPMENT CO., LTD., Guangdong (CN)

( * ) Notice: Subject to any disclaimer, the term of this patent is extended or adjusted under 35 U.S.C. 154(b) by 42 days.

(21) Appl. No.: 18/518,674

(22) Filed: Nov. 24, 2023

(65) Prior Publication Data

US 2024/0085034 A1 Mar. 14, 2024

Related U.S. Application Data

(63) Continuation of application No. PCT/CN2022/085844, filed on Apr. 8, 2022.

(30) Foreign Application Priority Data

Jul. 29, 2021 (CN) ..... 202121741054.5

(51) Int. Cl.
*F24F 1/36* (2011.01)
*F24F 13/22* (2006.01)
(Continued)

(52) U.S. Cl.
CPC ..... *F24F 1/36* (2013.01); *F24F 13/22* (2013.01); *F24F 1/32* (2013.01); *F24F 1/46* (2013.01)

(58) Field of Classification Search
CPC ..... F24F 1/36; F24F 1/32; F24F 1/46; F24F 1/0003; F24F 13/22; F24F 13/222; F24F 2013/221
See application file for complete search history.

(56) References Cited

U.S. PATENT DOCUMENTS

2014/0238506 A1* 8/2014 Adams ..... F24F 13/222 137/312
2017/0191677 A1* 7/2017 Jeong ..... F24F 1/0047

FOREIGN PATENT DOCUMENTS

CN 204880445 U 12/2015
CN 106288038 A 1/2017
(Continued)

OTHER PUBLICATIONS

CN 108592241 Machine Translation (Year: 2018).*
(Continued)

*Primary Examiner* — Joseph F Trpisovsky
(74) *Attorney, Agent, or Firm* — Scully, Scott, Murphy & Presser, P.C.

(57) ABSTRACT

An air conditioner outdoor unit and an air conditioner are provided. The outdoor unit includes a casing, a water receiving member, an accommodation cavity, a circulation component, and a partition. The water receiving member is disposed on the casing and has an opening. The accommodation cavity is between the casing and the water receiving member. The accommodation cavity is in communication with the opening. The circulation component has a first part located in the accommodation cavity and a second part passing through the opening to be in communication with a device to be communicated. The partition is disposed in the
(Continued)

water receiving member and located in the accommodation cavity. The accommodation cavity is divided into a first cavity and a second cavity by the partition.

18 Claims, 4 Drawing Sheets

(51) Int. Cl.
*F24F 1/32* (2011.01)
*F24F 1/46* (2011.01)

(56) References Cited

FOREIGN PATENT DOCUMENTS

| | | | | |
|---|---|---|---|---|
| CN | 106482244 | A | 3/2017 | |
| CN | 206160318 | U | 5/2017 | |
| CN | 10859241 | A | 9/2018 | |
| CN | 108592241 | A | 9/2018 | |
| CN | 108917139 | A | 11/2018 | |
| CN | 208920378 | U | 5/2019 | |
| CN | 110145812 | A | 8/2019 | |
| CN | 212005996 | U | 11/2020 | |
| CN | 215490055 | U | 1/2022 | |
| EP | 2716983 | A2 * | 4/2014 | ..... F24F 1/26 |
| JP | 2012132640 | A | 7/2012 | |
| JP | 2014181848 | A | 9/2014 | |

OTHER PUBLICATIONS

CN 208920378 Machine Translation (Year: 2019).*
International Search Report dated Jun. 30, 2022 issued in PCT/CN2022/085844.
Extended European search report dated Sep. 24, 2024 received in European Patent Application No. 22847875.6.
Written Opinion dated Jun. 30, 2022 received in International Application No. PCT/CN2022/085844.

* cited by examiner

AIR CONDITIONER OUTDOOR UNIT AND AIR CONDITIONER

CROSS-REFERENCE TO RELATED APPLICATIONS

This application is a continuation application of International Application No. PCT/CN2022/085844, filed on Apr. 8, 2022, which claims priority to and benefits of Chinese Patent Application No. 202121741054.5 filed on Jul. 29, 2021 and entitled "AIR CONDITIONER OUTDOOR UNIT AND AIR CONDITIONER", the entire disclosure of each of which is incorporated herein by reference. No new matter has been introduced.

FIELD

Embodiments of the present disclosure relate to the technical field of air conditioning devices, and more particularly, to an air conditioner outdoor unit and an air conditioner.

BACKGROUND

A split air conditioner includes an indoor unit and an outdoor unit. The indoor unit and the outdoor unit are connected to each other through a connection pipe, forming a closed refrigerant circuit on both indoor and outdoor sides. A refrigerant circularly flows between the indoor and outdoor sides, and absorbs and releases heat through a change of physical state of the refrigerant, which achieves refrigeration and heating of the air conditioner.

At present, in the related art, the refrigerant is generally pre-filled in the outdoor unit. A valve is provided on the outdoor unit. During installation, the indoor unit and the outdoor unit are connected to each other through the connection pipe by using tools such as a wrench or hex key. After the indoor unit and the connection pipe are emptied, a valve core is opened to realize refrigerant circulation. Due to a low temperature of the refrigerant, water vapor in the air condenses on the connection pipe to form water drops.

SUMMARY

Embodiments of the present disclosure aim to at least solve one of the technical problems existing in the related art.

To this end, a first aspect of the embodiments of the present disclosure provides an air conditioner outdoor unit.

A second aspect of the embodiments of the present disclosure provides an air conditioner.

In view of this, according to the first aspect of the embodiments of the present disclosure, provided is an air conditioner outdoor unit. The air conditioner outdoor unit includes a casing, a water receiving member, an accommodation cavity, a circulation component, and a partition. The water receiving member is disposed on the casing. The water receiving member has an opening. The accommodation cavity is located between the casing and the water receiving member. The accommodation cavity is in communication with the opening. The circulation component has a first part located in the accommodation cavity and a second part passing through the opening to be in communication with a device to be communicated. The partition is disposed in the water receiving member and located in the accommodation cavity. The accommodation cavity is divided into a first cavity and a second cavity by the partition. The first cavity is located closer to the opening than the second cavity. A part of the first part of the circulation component is located in the first cavity, and another part of the first part of the circulation component is located in the second cavity.

The air conditioner outdoor unit provided in the embodiments of the present disclosure includes the casing, the water receiving member, the accommodation cavity, the circulation component, and the partition. In some embodiments, the water receiving member is disposed on the casing, and the accommodation cavity is located between the casing and the water receiving member, i.e., the accommodation cavity is formed by enclosing at least a part of the water receiving member and a part of the casing. The water receiving member has the opening. The opening is in communication with the accommodation cavity. The first part of the circulation component is located in the accommodation cavity, and the second part of the circulation component is capable of passing through the opening to be in communication with the device to be communicated.

It can be understood that the device to be communicated may be an air conditioner indoor unit. The air conditioner outdoor unit and the air conditioner indoor unit are in communication with each other through the circulation component. In some embodiments, the circulation component includes a valve body and a pipeline, and the air conditioner outdoor unit is in communication with the air conditioner indoor unit through the pipeline, i.e., the first part of the circulation component is the valve body, and the second part of the circulation component is the pipeline. In this way, a closed refrigerant circulation circuit is formed between the air conditioner indoor unit and the air conditioner outdoor unit. A refrigerant circularly flows in the air conditioner indoor unit and the air conditioner outdoor unit, and absorbs and releases heat through a change of physical state of the refrigerant, which realizes a refrigeration function and a heating function of the air conditioner. Further, the valve body is configured to turn on or turn off a refrigerant circulation between the air conditioner outdoor unit and the air conditioner indoor unit. The valve body may also be configured to adjust a flow rate of the refrigerant. The flow rate of the refrigerant may be specifically set as desired.

During the refrigerant circulation, due to a low temperature of the refrigerant, water vapor in the air is readily condensed to form water drops on the circulation component connected to the air conditioner outdoor unit and the device to be communicated. By providing the water receiving member on the casing, the condensate water formed on the circulation component can be collected. Therefore, the condensate water is prevented from dripping, and the user experience of the air conditioner is enhanced.

In addition, the first part of the circulation component is located in the accommodation cavity, i.e., the water receiving member covers an outer side of the first part of the circulation component. In this way, the water receiving member can shield and protect the first part of the circulation component, thereby further prolonging a service life of the circulation component. It can be understood that the circulation component includes the valve body and the pipeline. The valve body may be located in the accommodation cavity. In this way, the water receiving member can shield and protect the valve body. A service life of the valve body can be further prolonged. Moreover, by forming the opening on the water receiving member, a connection between the pipeline and the valve body is facilitated. Moreover, it is also convenient for a user to maintain or replace the valve body through the opening.

Further, the partition is disposed on the water receiving member. Moreover, the accommodation cavity is divided into the first cavity and the second cavity by the partition. The first cavity is located closer to the opening than the second cavity. The part of the first part of the circulation component is located in the first cavity, and the other part of the first part of the circulation component is located in the second cavity, i.e., the part of the circulation component located in the accommodation cavity has a part located in the first cavity and another part located in the second cavity. That is, by providing the partition on the water receiving member, it is possible to allow the second cavity to form a relatively closed chamber. Therefore, in addition to collecting the condensate water formed on the circulation component, entry and accumulation of insects and rodents into the second cavity are effectively avoided, which enhances the user experience of the air conditioner.

It should be noted that the partition and the water receiving member can be integrally formed. It can be understood that an integrated structure has excellent mechanical properties. Therefore, stability of the partition in the water receiving member can be improved. Moreover, it is possible to effectively block insects and rodents. In addition, the integrated structure also facilitates processing and production. Therefore, the processing difficulty of the water receiving member and the partition can be decreased. In addition, it is possible to improve production efficiency and lower production costs.

In addition, the air conditioner outdoor unit provided according to the above technical solutions of the present disclosure also has the following additional technical features:

In a possible technical solution, the casing is provided with a compressor; the first part of the circulation component is a valve body having a first end in communication with the compressor; and the second part of the circulation component is a pipeline. The pipeline has a first end in communication with a second end of the valve body and a second end. The second end of the pipeline passes through the opening and is in communication with the device to be communicated. A part of the valve body is located in the first cavity, and another part of the valve body is located in the second cavity.

In this technical solution, an exemplary structure of the circulation component is defined. In some embodiments, the casing is provided with a compressor. It can be understood that the compressor is configured to store the refrigerant. The first end of the valve body is in communication with the compressor. The second end of the valve body is in communication with the first end of the pipeline. The second end of the pipeline is in communication with the device to be communicated. For example, the device to be communicated is the air conditioner indoor unit. After the air conditioner indoor unit and the pipeline are emptied, the valve body is opened to realize the circulation of the refrigerant. During operation of the air conditioner, the refrigerant circularly flows between the air conditioner indoor unit and the air conditioner outdoor unit. Due to a decrease in a temperature of the refrigerant, the water vapor in the air is easily condensed to form water drops on the pipeline. By providing the water receiving member on the casing, it is possible to collect the condensate water and to reduce the dropping of the condensate water.

Further, the part of the valve body is located in the first cavity, and the other part of the valve body is located in the second cavity. In this way, it is possible to allow the partition and the valve body to engage with each other to implement insects prevention and rodents prevention. In addition, it can be understood that the partition needs to have an avoidance opening. In this way, the part of the valve body is located in the first cavity, and the other part of the valve body is located in the second cavity. Therefore, material used for the partition can be saved, while insects prevention and rodents prevention can be implemented. Moreover, a production cost of the air conditioner outdoor unit is further lowered.

It should be noted that two valve bodies may be provided, one of the two valve bodies is a high-pressure valve, and another one of the two valve bodies is a low-pressure valve. In this way, control of the refrigerant circulation is realized.

In a possible technical solution, the partition includes a body and an avoidance opening formed in the body. The first cavity is in communication with the second cavity through the avoidance opening, and a part of the valve body is located in the avoidance opening.

In this technical solution, it is defined that the partition includes the body and the avoidance opening. In some embodiments, the avoidance opening is formed on the body, and the first cavity is in communication with the second cavity through the avoidance opening. That is, the avoidance opening is formed on the body, allowing the part of the valve body to be located in the first cavity and the other part of the valve body to be located in the second cavity. Therefore, the material used for the partition can be saved, while insects prevention and rodents prevention can be implemented. Further, the production cost of the air conditioner outdoor unit is lowered. Moreover, the insects prevention and rodents prevention can be implemented through the engagement between the partition and the valve body.

The part of the valve body is located in the avoidance opening, i.e., a part of the valve body located in the avoidance opening engages with the body to block insects and rodents. Therefore, the insects and rodents are effectively prevented from entering and accumulating in the second cavity. In addition, the user experience of the product is enhanced.

It can be understood that the avoidance opening has a number corresponding to a number of the valve body.

In a possible technical solution, the avoidance opening has a shape corresponding to a shape of the valve body.

In this technical solution, the avoidance opening has the shape corresponding to the shape of the valve body, allowing for a small spacing between the part of the valve body located in the avoidance opening and the body. In this way, the insects and rodents are effectively prevented from entering and accumulating in the second cavity from a gap between the body and the part of the valve body located in the avoidance opening. Therefore, a blocking effect on the insects and rodents is enhanced.

In a possible technical solution, a spacing d between a part of the body located in the avoidance opening and the valve body satisfies $d<10$ mm.

In this technical solution, a value range of the spacing between the part of the body located in the avoidance opening and the valve body is defined. In some embodiments, the spacing between the part of the body located in the avoidance opening and the valve body is smaller than 10 mm, i.e., a spacing between the part of the body located in the avoidance opening and the part of the valve body located in the avoidance opening is defined. Moreover, the spacing is defined to be smaller than 10 mm. In this way, it is possible to effectively prevent the insects and rodents from entering and accumulating in the second cavity from a gap between the body and the valve body. Therefore, the user experience of the air conditioner is further enhanced.

It can be understood that in response to a spacing between the body and the valve body being greater than 10 mm, the insects and rodents easily enter the second cavity from the gap between the body and the valve body. By setting the spacing to be smaller than 10 mm, it is possible to effectively prevent the insects and rodents from entering the second cavity from the gap between the body and the valve body. In this way, a blocking effect of the partition is improved.

In a possible technical solution, the water receiving member further includes: a housing having the accommodation cavity; and a water receiving groove formed at the housing and located in the first cavity. An opening of the water receiving groove faces towards the circulation component.

In this technical solution, it is defined that the water receiving member also includes the housing and the water receiving groove. In some embodiments, the housing has the accommodation cavity, i.e., the water receiving member covers an outer side of the valve body. In this way, protection for the valve body is performed and the service life of the valve body is prolonged.

Further, the water receiving groove is located at the housing. Moreover, the water receiving groove is located in the first cavity. The opening of the water receiving groove faces towards the circulation component. Therefore, the collection of the condensate water condensed on the pipeline or the valve body is performed.

In a possible technical solution, the water receiving groove is detachably formed on the housing.

In this technical solution, it is defined that the water receiving groove is detachably formed on the housing. In some embodiments, the water receiving groove may be detached from the housing. After disposal of the condensate water stored in the water receiving groove, the water receiving groove is re-mounted on the housing. By detachably locating the water receiving groove on the housing, treatment on the condensate water collected in the water receiving groove is facilitated. In this way, an overflow of the collected condensate water from the water receiving groove, which is caused by excessive condensate water collected in the water receiving groove after prolonged use of the air conditioner, is avoided. Therefore, user experience of the air conditioner having the air conditioner outdoor unit is further enhanced.

In a possible technical solution, a side wall of the water receiving groove has a drainage outlet. The water receiving member further includes a plugging member disposed at the housing. The plugging member is configured to open or close the drainage outlet.

In this technical solution, another way of treating the condensate water is defined. In some embodiments, the side wall of the water receiving groove has the drainage outlet, and the plugging member may open or close the drainage outlet. After the prolonged use of the air conditioner, the drainage outlet may be opened through the plugging member. In this way, discharge of the condensate water in the water receiving groove is realized without the need to detach the water receiving groove from the housing. Therefore, the treatment of the condensate water in the water receiving groove is facilitated.

It should be noted that the water receiving member may also include a connection portion. The connection portion has an end connected to the housing and another end connected to the plugging member. In this way, the plugging member is prevented from being lost, while the drainage outlet is opened or closed through the plugging member to perform the treatment on the condensate water in the water receiving groove. Moreover, it is ensured that the water receiving groove collects the condensate water condensed on the valve body or the pipeline.

In a possible technical solution, the air conditioner outdoor unit further includes a connection wire connected to the device to be communicated. The water receiving member further includes a wire binding hole formed on the housing. The connection wire is capable of passing through the wire binding hole.

In this technical solution, it is defined that the air conditioner outdoor unit further includes the connection wire, and that the water receiving member also includes the wire binding hole. In some embodiments, the connection wire is connected to the device to be communicated. It can be understood that the device to be communicated may be, but is not limited to, the air conditioner indoor unit. The connection wire has an end connected to the air conditioner outdoor unit and another end connected to the air conditioner indoor unit. The housing also has the wire binding hole. The connection wire is capable of passing through the wire binding hole, i.e., the connection wire has the end connected to the air conditioner outdoor unit and the other end that passes through the wire binding hole and then is connected to the air conditioner indoor unit. In this way, wiring can be standardized, avoiding the risk of disengagement of the connection wire caused by tangling of the connection wire. Moreover, it is also possible to enhance aesthetics of the air conditioner outdoor unit.

It should be noted that a fastener may be provided at a position of housing close to the wire binding hole. After the connection wire passes through the wire binding hole and is connected to the air conditioner indoor unit, a part of the connection wire passing through the wire binding hole may be fixed through the fastener. In this way, in addition to standard wiring, it is avoided that gravity of the connection wire is concentrated at a position where the connection wire is connected to the air conditioner outdoor unit. Therefore, the risk of the disengagement of the connection wire is reduced. It can be understood that the connection wire may be an electrical connection wire. The connection wire is fixed after passing through the wire binding hole. In this way, when the disengagement of the connection wire is prevented, electricity safety of the air conditioner is improved, and stable operation of the air conditioner is ensured.

It should be noted that the number of the wire binding holes may be set as required. In response to providing a plurality of connection wires of the air conditioner outdoor unit, a plurality of wire binding holes may be correspondingly formed on the housing, to standardize wiring of the air conditioner outdoor unit.

Here, the air conditioner outdoor unit is provided with a connection base. The connection base is connected to the connection wire.

In a possible technical solution, the wire binding hole is formed at a side of the housing facing away from the water receiving groove.

In this technical solution, an arrangement position of the wire binding hole is defined. In some embodiments, the wire binding hole is formed at the side of the housing facing away from the water receiving groove. It can be understood that the water receiving groove is configured to collect the condensate water condensed on the pipeline. The connection wire is generally the electrical connection wire. By forming the wire binding hole at the side of the housing facing away from the water receiving groove, a problem of electrical failure of the air conditioner, which is caused by the aging of the connection wire and contact of the connection wire with the condensate water in the water receiving groove after the prolonged use of the air conditioner, can be prevented. Therefore, the electricity safety of the air conditioner is further enhanced. Moreover, operation stability of the air conditioner is improved. In addition, a service life of the air conditioner outdoor unit and a service life of the air conditioner having the air conditioner outdoor unit are prolonged.

In a possible technical solution, the air conditioner outdoor unit further includes a fastener disposed at the water receiving member close to the wire binding hole.

In this technical solution, it is defined that the air conditioner outdoor unit also includes the fastener. In some embodiments, the fastener is disposed on the water receiving member close to the wire binding hole, i.e., after the connection wire passes through the wire binding hole and is connected to the air conditioner indoor unit, the part of the connection wire passing through the wire binding hole may be fixed through the fastener. In this way, in addition to standard wiring, it is avoided that the gravity of the connection wire is concentrated at the position where the connection wire is connected to the air conditioner outdoor unit. Moreover, the risk of the disengagement of the connection wire is reduced. It can be understood that the connection wire may be the electrical connection wire. The connection wire is fixed after passing through the wire binding hole, which improves the electricity safety of the air conditioner while avoids the disengagement of the connection wire. Therefore, the stable operation of the air conditioner is ensured.

It should be noted that the number of the wire binding holes may be set as required. In response to having the plurality of connection wires of the air conditioner outdoor unit, the plurality of wire binding holes may be correspondingly formed on the housing to standardize the wiring of the air conditioner outdoor unit. The number of the fasteners has a one-to-one correspondence to the number of the wire binding holes. Therefore, in addition to standard wiring, it is avoided that the gravity of the connection wire is concentrated at the position where the connection wire is connected to the air conditioner outdoor unit. In addition, the risk of the disengagement of the connection wire is reduced.

In a possible technical solution, an outer edge of the water receiving member is bent towards a side facing away from the accommodation cavity to form a mounting portion; and the water receiving member is disposed on the casing through the mounting portion.

In this technical solution, a part of the outer edge of the water receiving member is bent towards the side facing away from the accommodation cavity to form the mounting portion. Moreover, the water receiving member is mounted on the casing through the mounting portion. By providing the mounting portion to achieve a fixed connection between the water receiving member and the casing, it is possible to enhance strength of the connection between the water receiving member and the casing and ensure that the water receiving member can collect the condensate water condensed on the circulation component. Moreover, the water receiving member covers the outer side of the valve body. By improving the strength of the connection between the water receiving member and the casing, it is also possible to improve a protection effect of the water receiving member on the valve body. Moreover, the service life of the valve body is further prolonged.

It can be understood that the mounting portion is a part of the water receiving member, i.e., the housing and the mounting portion are integrally formed. It can be understood that the integrated structure has good mechanical properties. In this way, strength of a connection between the housing and the mounting portion can be improved. The strength of the connection between the water receiving member and the casing can be further improved. Therefore, it is ensured that the water receiving member can collect the condensate water condensed on the circulation component. In addition, the integrated structure also facilitates the processing and production. Therefore, the processing difficulty of the water receiving member can be reduced. The production efficiency is improved, and the production cost is lowered.

In a possible technical solution, the mounting portion has a plurality of connection holes; and the air conditioner outdoor unit further includes a plurality of connectors having a one-to-one correspondence to the plurality of connection holes.

In this technical solution, it is defined that the mounting portion has the plurality of connection holes. In some embodiments, the air conditioner outdoor unit also includes the plurality of connectors having a one-to-one correspondence to the plurality of connection holes. The plurality of connectors may pass through the plurality of connection holes, which realizes fixed mounting of the water receiving member and the casing through the mounting portion. By providing the plurality of connectors having a one-to-one correspondence to the plurality of connection holes, it is possible to improve a connection effect between the water receiving member and the casing. Moreover, it is ensured that the water receiving member can collect the condensate water condensed on the circulation component.

It should be noted that the connection hole may be a threaded hole. The connector may be a screw. The screw passes through the threaded hole to achieve the fixation and mounting of the water receiving member and the casing.

In a possible technical solution, the partition and the water receiving member are integrally formed.

In this technical solution, it is defined that the partition and the water receiving member are integrally formed. It can be understood that the integrated structure possesses excellent mechanical properties. Therefore, the stability of the partition in the water receiving member can be improved. In this way, the prevention for the insects and rodents can be effectively implemented. In addition, the integrated structure also facilitates the processing and production. Therefore, the processing difficulty of the water receiving member and the partition can be reduced. In addition, the production efficiency is improved, and the production cost is lowered.

According to a second aspect of the present disclosure, provided is an air conditioner, including: the air conditioner outdoor unit provided by any one of the above technical solutions. Therefore, the air conditioner has all the beneficial technical effects of the air conditioner outdoor unit provided by any one of the above technical solutions, and details are omitted herein.

Further, the air conditioner also includes an air conditioner indoor unit. The air conditioner indoor unit is in communication with a second part of a circulation component of the air conditioner outdoor unit.

The air conditioner provided in the embodiments of the present disclosure includes the air conditioner outdoor unit and the air conditioner indoor unit. In some embodiments, the air conditioner outdoor unit and the air conditioner indoor unit are in communication with each other through the circulation component. In a further embodiment, the circulation component includes the valve body and the pipeline. The air conditioner outdoor unit is in communication with the air conditioner indoor unit through the pipeline. After the valve body is opened, the closed refrigerant circulation circuit is formed between the air conditioner indoor unit and the air conditioner outdoor unit. The refrigerant circularly flows in the air conditioner indoor unit and the air conditioner outdoor unit, and the refrigerant absorbs heat and releases heat through the change of physical state of the refrigerant. Further, the refrigeration function and heating function of the air conditioner are achieved.

During the refrigerant circulation, due to the low temperature of the refrigerant, the water vapor in the air is easily condensed to form water drops on the circulation component connected to the air conditioner outdoor unit and the device to be communicated. By providing the water receiving member on the casing, it is possible to collect the condensate water formed on the circulation component. Moreover, the condensate water is prevented from dripping, and the user experience of the air conditioner is enhanced.

In addition, the first part of the circulation component is located in the accommodation cavity, i.e., the water receiving member covers the outer side of the first part of the circulation component. In this way, the water receiving member can shield and protect the first part of the circulation component. Therefore, the service life of the circulation component is further prolonged. It can be understood that the circulation component includes the valve body and the pipeline. The valve body can be located in the accommodation cavity, allowing the water receiving member to shield and protect the valve body. In this way, the service life of the valve body can be further prolonged. Moreover, the opening is formed on the water receiving member. Therefore, the connection between the pipeline and the valve body is facilitated, making it convenient for the user to maintain or replace the valve body through the opening.

Further, the partition is disposed on the water receiving member. Moreover, the accommodation cavity is divided into the first cavity and the second cavity by the partition. The first cavity is disposed closer to the opening than the second cavity. The part of the first part of the circulation component is located in the first cavity, and the other part of the first part of the circulation component is located in the second cavity, i.e., the part of the circulation component located in the accommodation cavity has the part located in the first cavity and the other part located in the second cavity. That is, by providing the partition on the water receiving member, it is possible to allow the second cavity to form the relatively closed chamber. Therefore, in addition to collecting the condensate water formed on the circulation component, it is possible to effectively prevent the insects and rodents from entering and accumulating in the second cavity. In this way, the user experience of the air conditioner is improved.

Additional aspects and advantages of the present disclosure will be provided in part in the following description, or become apparent in part from the following description, or can be learned from practicing of the present disclosure.

BRIEF DESCRIPTION OF THE DRAWINGS

The above and/or additional aspects and advantages of the present disclosure will become apparent and readily appreciated through the following description of embodiments in combination with the accompanying drawings, in which.

Figure 1:
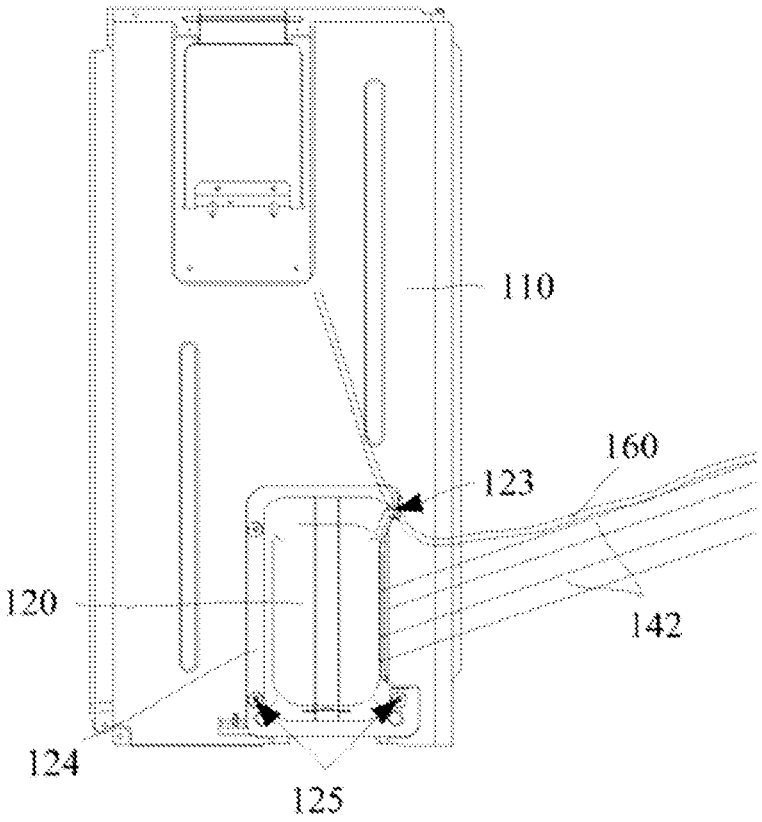
FIG. 1 illustrates a first partial schematic structural view of an air conditioner outdoor unit according to an embodiment of the present disclosure.

Here, a correspondence between reference numerals and component names in FIG. 1 to FIG. 4 is:

110 casing, 120 water receiving member, 121 housing, 122 water receiving groove, 123 wire binding hole, 124 mounting portion, 125 connection hole, 130 accommodation cavity, 131 first cavity, 132 second cavity, 141 valve body, 142 pipeline, 150 partition, 151 body, 152 avoidance opening, 160 connection wire.

DETAILED DESCRIPTION OF EMBODIMENTS

In order to more clearly understand the above objects, features and advantages of the present disclosure, the present disclosure will be further described in detail below in conjunction with the accompanying drawings and specific implementations. It should be noted that embodiments of the present disclosure and features in the embodiments can be combined with each other without conflicting.

In the following description, many specific details are set forth to facilitate full understanding of the present disclosure. However, the present disclosure may also be implemented by using other different manners described herein. Therefore, the scope of the present disclosure is not limited by exemplary embodiments disclosed below.

An air conditioner outdoor unit and an air conditioner according to some embodiments of the present disclosure are described below with reference to FIG. 1 to FIG. 4.

As illustrated in FIG. 1, FIG. 2, FIG. 3, and FIG. 4, embodiments of a first aspect of the present disclosure provide an air conditioner outdoor unit. The air conditioner outdoor unit includes a casing 110, a water receiving member 120, an accommodation cavity 130, a circulation component, and a partition 150. The water receiving member 120 is disposed on the casing 110. The water receiving member 120 has an opening. The accommodation cavity 130 is located between the casing 110 and the water receiving member 120. The accommodation cavity 130 is in communication with the opening. The circulation component has a first part located in the accommodation cavity 130 and a second part passing through the opening to be in communication with a device to be communicated. The partition 150 is disposed in the water receiving member 120 and located in the accommodation cavity 130. The accommodation cavity 130 is divided into a first cavity 131 and a second cavity 132 by the partition 150. The first cavity 131 is located closer to the opening than the second cavity 132. A part of the first part of the circulation component is located in the first cavity 131, and another part of the first part of the circulation component is located in the second cavity 132.

The air conditioner outdoor unit provided in the embodiments of the present disclosure includes the casing 110, the water receiving member 120, the accommodation cavity 130, the circulation component, and the partition 150. In some embodiments, the water receiving member 120 is disposed on the casing 110, and the accommodation cavity 130 is located between the casing 110 and the water receiving member 120, i.e., the accommodation cavity 130 is formed by enclosing at least a part of the water receiving member 120 and a part of the casing 110. The water receiving member 120 has the opening. The opening is in communication with the accommodation cavity 130. The first part of the circulation component is located in the accommodation cavity 130, and the second part of the circulation component is capable of passing through the opening to be in communication with the device to be communicated.

It can be understood that the device to be communicated may be an air conditioner indoor unit. The air conditioner outdoor unit and the air conditioner indoor unit are in communication with each other through the circulation component. In some embodiments, the circulation component includes a valve body 141 and a pipeline 142, and the air conditioner outdoor unit is in communication with the air conditioner indoor unit through the pipeline 142, i.e., the first part of the circulation component is the valve body 141, and the second part of the circulation component is the pipeline 142. In this way, a closed refrigerant circulation circuit is formed between the air conditioner indoor unit and the air conditioner outdoor unit. A refrigerant circularly flows in the air conditioner indoor unit and the air conditioner outdoor unit, and absorbs and releases heat through a change of physical state of the refrigerant, which further realizes a refrigeration function and a heating function of the air conditioner. Further, the valve body 141 is configured to turn on or turn off a refrigerant circulation between the air conditioner outdoor unit and the air conditioner indoor unit. The valve body 141 may also be configured to adjust a flow rate of the refrigerant. The flow rate of the refrigerant may be specifically set as desired.

During the refrigerant circulation, due to a low temperature of the refrigerant, water vapor in the air is easily condensed to form water drops on the circulation component connected to the air conditioner outdoor unit and the device to be communicated. By providing the water receiving member 120 on the casing 110, the condensate water formed on the circulation component can be collected. Therefore, the condensate water is prevented from dripping, and the user experience of the air conditioner is enhanced.

In addition, the first part of the circulation component is located in the accommodation cavity 130, i.e., the water receiving member 120 covers an outer side of the first part of the circulation component. In this way, the water receiving member 120 can shield and protect the first part of the circulation component, further prolonging a service life of the circulation component. It can be understood that the circulation component includes the valve body 141 and the pipeline 142. The valve body 141 can be located in the accommodation cavity 130. In this way, the water receiving member 120 can shield and protect the valve body 141. A service life of the valve body 141 can be further prolonged. Moreover, by forming the opening on the water receiving member 120, a connection between the pipeline 142 and the valve body 141 is facilitated. Moreover, it is also convenient for a user to maintain or replace the valve body 141 through the opening.

Further, the partition 150 is disposed on the water receiving member 120. The accommodation cavity 130 is divided into the first cavity 131 and the second cavity 132 by the partition 150. The first cavity 131 is located closer to the opening than the second cavity 132. The part of the first part of the circulation component is located in the first cavity 131, and the other part of the first part of the circulation component is located in the second cavity 132, i.e., the part of the circulation component located in the accommodation cavity 130 has a part located in the first cavity 131 and another part located in the second cavity 132. That is, by providing the partition 150 on the water receiving member 120, it is possible to allow the second cavity 132 to form a relatively closed chamber. Therefore, in addition to collecting the condensate water formed on the circulation component, entry and accumulation of insects and rodents into the second cavity 132 are effectively avoided, which enhances the user experience.

It should be noted that the partition 150 and the water receiving member 120 can be integrally formed. It can be understood that an integrated structure has excellent mechanical properties. Therefore, stability of the partition 150 in the water receiving member 120 can be improved. Moreover, it is possible to effectively block insects and rodents. In addition, the integrated structure also facilitates processing and production. Therefore, the processing difficulty of the water receiving member 120 and the partition 150 can be decreased. In addition, it is possible to improve production efficiency and lower production costs.

Figure 2:
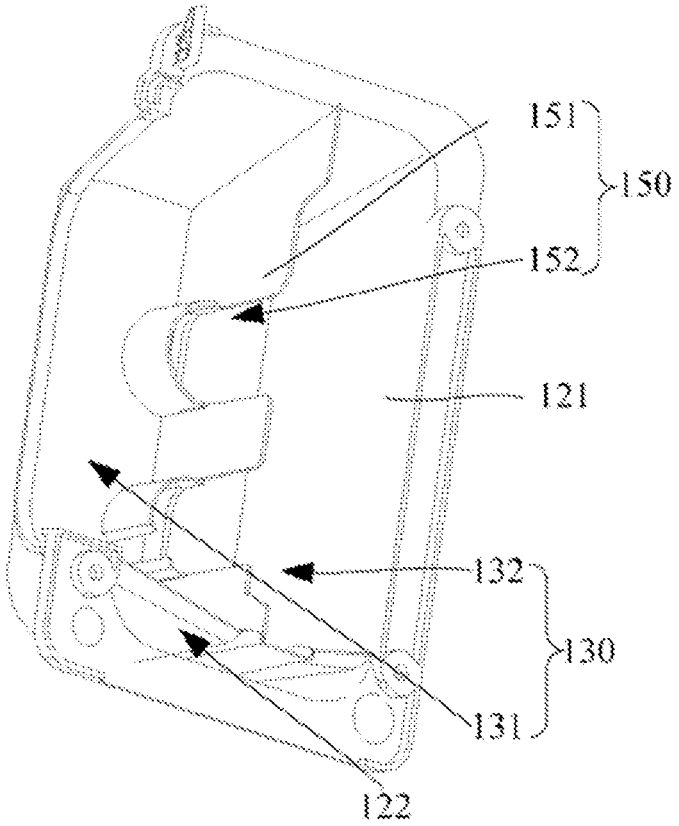
FIG. 2 illustrates a partial schematic structural view of a water receiving member according to an embodiment of the present disclosure.
Figure 3:
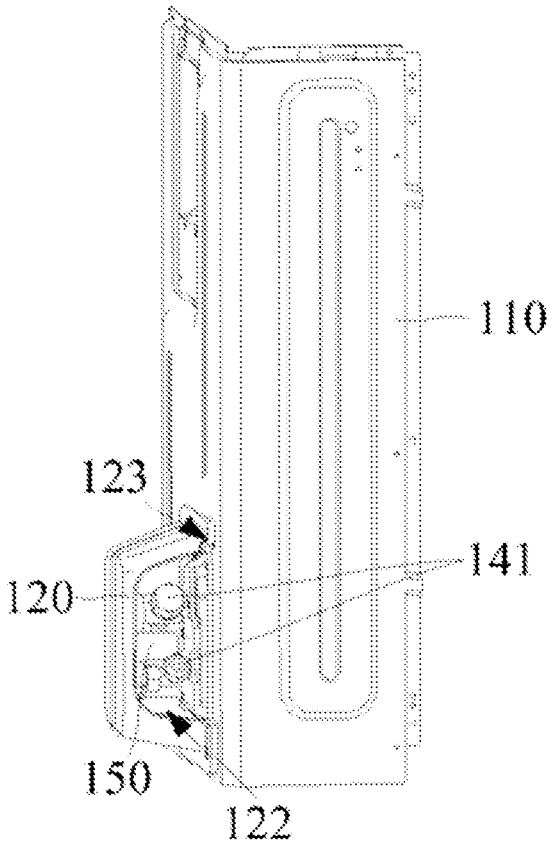
FIG. 3 illustrates a second partial schematic structural view of an air conditioner outdoor unit according to an embodiment of the present disclosure.

As illustrated in FIG. 1, FIG. 2, and FIG. 3, on the basis of the above embodiments, further, the casing 110 is provided with a compressor; the first part of the circulation component is a valve body 141 having a first end in communication with the compressor; and the second part of the circulation component is a pipeline 142. The pipeline 142 has a first end in communication with a second end of the valve body 141 and a second end. The second end of the pipeline 142 passes through the opening and is in communication with the device to be communicated. A part of the valve body 141 is located in the first cavity 131, and another part of the valve body 141 is located in the second cavity 132.

In this embodiment, a structure of the circulation component is defined. In some embodiments, the casing 110 is provided with a compressor. It can be understood that the compressor is configured to store the refrigerant. The first end of the valve body 141 is in communication with the compressor. The second end of the valve body 141 is in communication with the first end of the pipeline 142. The second end of the pipeline 142 is in communication with the device to be communicated. For example, the device to be communicated is the air conditioner indoor unit. After the air conditioner indoor unit and the pipeline 142 are emptied, the valve body 141 is opened to realize the circulation of the refrigerant. During operation of the air conditioner, the refrigerant circularly flows between the air conditioner indoor unit and the air conditioner outdoor unit. Due to a decrease in a temperature of the refrigerant, the water vapor in the air is easily condensed to form water drops on the pipeline 142. By providing the water receiving member 120 on the casing 110, it is possible to collect the condensate water and to reduce the dropping of the condensate water.

Further, the part of the valve body 141 is located in the first cavity 131, and the other part of the valve body 141 is located in the second cavity 132. In this way, it is possible to allow the partition 150 and the valve body 141 to engage with each other to implement insects prevention and rodents prevention. In addition, it can be understood that the partition 150 needs to have an avoidance opening 152. In this way, the part of the valve body 141 is located in the first cavity 131, and the other part of the valve body 141 is located in the second cavity 132. Therefore, material used for the partition 150 can be saved, while the insects prevention and rodents prevention are implemented. Moreover, a production cost of the air conditioner outdoor unit is further lowered.

It should be noted that two valve bodies 141 may be provided, one of the two valve bodies 141 is a high-pressure valve, and another one of the two valve bodies 141 is a low-pressure valve. In this way, control of the refrigerant circulation is realized.

Figure 4:
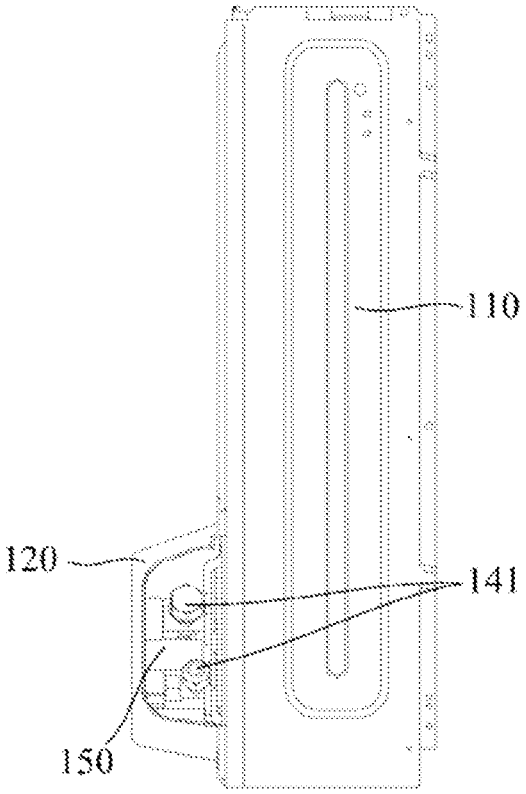
FIG. 4 illustrates a third partial schematic structural view of an air conditioner outdoor unit according to an embodiment of the present disclosure.

As illustrated in FIG. 4, on the basis of the above embodiments, further, the partition 150 includes a body 151 and an avoidance opening 152 formed in the body 151. The first cavity 131 is in communication with the second cavity 132 through the avoidance opening 152, and a part of the valve body 141 is located in the avoidance opening 152.

In this embodiment, it is defined that the partition 150 includes the body 151 and the avoidance opening 152. In some embodiments, the avoidance opening 152 is formed on the body 151, and the first cavity 131 is in communication with the second cavity 132 through the avoidance opening 152. That is, the avoidance opening 152 is formed on the body 151, allowing the part of the valve body 141 to be located in the first cavity 131 and the other part of the valve body 141 to be located in the second cavity 132. Therefore, the material used for the partition 150 can be saved, while the insects prevention and rodents prevention are implemented. Further, the production cost of the air conditioner outdoor unit is lowered. Moreover, the insects prevention and rodents prevention can be implemented through an engagement between the partition 150 and the valve body 141.

The part of the valve body 141 is located in the avoidance opening 152, i.e., a part of the valve body 141 located in the avoidance opening 152 engages with the body 151 to block the insects and rodents. Therefore, the insects and rodents are effectively prevented from entering and accumulating in the second cavity 132. In addition, the user experience of the air conditioner is enhanced.

It can be understood that the avoidance openings 152 has a number corresponding to a number of the valve bodies 141.

In an exemplary embodiment, further, the avoidance opening 152 has a shape corresponding to a shape of the valve body 141.

In this embodiment, the avoidance opening 152 has the shape corresponding to the shape of the valve body 141, allowing for a small spacing between the part of the valve body 141 located in the avoidance opening 152 and the body 151. In this way, the insects and rodents are effectively prevented from entering and accumulating in the second cavity 132 from a gap between the body 151 and the part of the valve body 141 located in the avoidance opening 152. Therefore, a blocking effect on the insects and rodents is increased.

In another exemplary embodiment, a spacing d between a part of the body 151 located in the avoidance opening 152 and the valve body 141 satisfies $d<10$ mm.

In this embodiment, a value range of the spacing between the part of the body 151 located in the avoidance opening 152 and the valve body 141 is defined. In some embodiments, the spacing between the part of the body 151 located in the avoidance opening 152 and the valve body 141 is smaller than 10 mm, i.e., a spacing between the part of the body 151 located in the avoidance opening 152 and the part of the valve body 141 located in the avoidance opening 152 is defined. Moreover, the spacing is defined to be smaller than 10 mm. In this way, it is possible to effectively prevent the insects and rodents from entering and accumulating in the second cavity 132 from a gap between the body 151 and the valve body 141. Therefore, the user experience is further enhanced.

It can be understood that in response to a spacing between the body 151 and the valve body 141 being greater than 10 mm, the insects and rodents easily enter the second cavity 132 from the gap between the body 151 and the valve body 141. By setting the spacing to be smaller than 10 mm, it is possible to effectively prevent the insects and rodents from entering the second cavity 132 from the gap between the body 151 and the valve body 141. In this way, a blocking effect of the partition 150 is improved.

As illustrated in FIG. 1, FIG. 2, FIG. 3, and FIG. 4, on the basis of any one of the above embodiments, further, the water receiving member 120 further includes a housing 121 and a water receiving groove 122. The housing 121 has the accommodation cavity 130. The water receiving groove 122 is formed at the housing 121 and located in the first cavity 131. An opening of the water receiving groove 122 faces towards the circulation component.

In this embodiment, it is defined that the water receiving member 120 also includes the housing 121 and the water receiving groove 122. In some embodiments, the housing 121 has the accommodation cavity 130, i.e., the water receiving member 120 covers an outer side of the valve body 141. In this way, protection for the valve body 141 is performed and the service life of the valve body 141 is prolonged.

Further, the water receiving groove 122 is located at the housing 121. Moreover, the water receiving groove 122 is located in the first cavity 131. The opening of the water receiving groove 122 faces towards the circulation component. Therefore, the collection of the condensate water condensed on the pipeline 142 or the valve body 141 is performed.

In an exemplary embodiment, further, the water receiving groove 122 is detachably formed on the housing 121.

In this embodiment, it is defined that the water receiving groove 122 is detachably formed on the housing 121. In some embodiments, the water receiving groove 122 may be detached from the housing 121. After disposal of the condensate water stored in the water receiving groove 122, the water receiving groove 122 is re-mounted on the housing 121. By detachably locating the water receiving groove 122 on the housing 121, it is convenient to perform treatment on the condensate water collected in the water receiving groove 122. In this way, an overflow of the collected condensate water from the water receiving groove 122, which is caused by excessive condensate water collected in the water receiving groove 122 after prolonged use of the air conditioner, is avoided. Therefore, a user experience of the air conditioner having the air conditioner outdoor unit is further enhanced.

In another exemplary embodiment, further, a side wall of the water receiving groove 122 has a drainage outlet. The water receiving member 120 further includes a plugging member. The plugging member is disposed at the housing 121. The plugging member is configured to open or close the drainage outlet.

In this embodiment, another way of treating the condensate water is defined. In some embodiments, the side wall of the water receiving groove 122 has the drainage outlet, and the plugging member may open or close the drainage outlet. After the prolonged use of the air conditioner, the drainage outlet may be opened through the plugging member. In this way, discharge of the condensate water in the water receiving groove 122 is realized without the need to detach the water receiving groove 122 from the housing 121. Therefore, the treatment of the condensate water in the water receiving groove 122 is facilitated.

It should be noted that the water receiving member 120 may also include a connection portion. The connection portion has an end connected to the housing 121 and another end connected to the plugging member. In this way, the plugging member is prevented from being lost, while the drainage outlet is opened or closed through the plugging member to perform the treatment on the condensate water in the water receiving groove 122. Moreover, it is ensured that the water receiving groove 122 collects the condensate water condensed on the valve body 141 or the pipeline 142.

As illustrated in FIG. 1, FIG. 2, FIG. 3, and FIG. 4, on the basis of any one of the above embodiments, further, the air conditioner outdoor unit further includes a connection wire 160. The connection wire 160 is connected to the device to be communicated. The water receiving member 120 further includes a wire binding hole 123. The wire binding hole 123 is formed on the housing 121. The connection wire 160 is capable of passing through the wire binding hole 123.

In this embodiment, it is defined that the air conditioner outdoor unit also includes the connection wire 160, and that the water receiving member 120 also includes the wire binding hole 123. In some embodiments, the connection wire 160 is connected to the device to be communicated. It can be understood that the device to be communicated may be, but is not limited to, the air conditioner indoor unit. The connection wire 160 has an end connected to the air conditioner outdoor unit and another end connected to the air conditioner indoor unit. The housing 121 also has the wire binding hole 123. The connection wire 160 is capable of passing through the wire binding hole 123, i.e., the connection wire 160 has the end connected to the air conditioner outdoor unit and the other end that passes through the wire binding hole 123 and then is connected to the air conditioner indoor unit. In this way, wiring can be standardized, avoiding the risk of disengagement of the connection wire 160 caused by tangling of the connection wire 160. Moreover, it is also possible to enhance aesthetics of the air conditioner outdoor unit.

It should be noted that a fastener may be provided at a position of the housing 121 close to the wire binding hole 123. After the connection wire 160 passes through the wire binding hole 123 and is connected to the air conditioner indoor unit, a part of the connection wire 160 passing through the wire binding hole 123 may be fixed through the fastener. In this way, in addition to standard wiring, it is avoided that gravity of the connection wire 160 is concentrated at a position where the connection wire is connected to the air conditioner outdoor unit. Therefore, the risk of the disengagement of the connection wire 160 is reduced. It can be understood that the connection wire 160 may be an electrical connection wire 160. The connection wire 160 is fixed after passing through the wire binding hole 123. In this way, when the disengagement of the connection wire 160 is avoided, electricity safety of the air conditioner is improved, and stable operation of the air conditioner is ensured.

It should be noted that the number of the wire binding holes 123 may be set as required. In response to providing a plurality of connection wires 160 of the air conditioner outdoor unit, a plurality of wire binding holes 123 may be correspondingly formed on the housing 121, to standardize wiring of the air conditioner outdoor unit.

Here, the air conditioner outdoor unit is provided with a connection base. The connection base is connected to the connection wire 160.

In an exemplary embodiment, further, the wire binding hole 123 is formed at a side of the housing 121 facing away from the water receiving groove 122.

In this embodiment, an arrangement position of the wire binding hole 123 is defined. In some embodiments, the wire binding hole 123 is formed at the side of the housing 121 facing away from the water receiving groove 122. It can be understood that the water receiving groove 122 is configured to collect the condensate water condensed on the pipeline 142. The connection wire 160 is generally the electrical connection wire 160. By forming the wire binding hole 123 at the side of the housing 121 facing away from the water receiving groove 122, a problem of electrical failure of the air conditioner, which is caused by the aging of the connection wire 160 and contact of the connection wire 160 with the condensate water in the water receiving groove 122 after the prolonged use of the air conditioner, can be prevented. Therefore, the electricity safety of the air conditioner is further enhanced. Moreover, operation stability of the air conditioner is improved. In addition, a service life of the air conditioner outdoor unit and a service life of the air conditioner having the air conditioner outdoor unit are prolonged.

On the basis of the above embodiments, further, the air conditioner outdoor unit further includes a fastener. The fastener is disposed at the water receiving member 120 close to the wire binding hole 123.

In this embodiment, it is defined that the air conditioner outdoor unit also includes the fastener. In some embodiments, the fastener is disposed at the water receiving member 120 close to the wire binding hole 123, i.e., after the connection wire 160 passes through the wire binding hole 123 and is connected to the air conditioner indoor unit, the part of the connection wire 160 passing through the wire binding hole 123 may be fixed through the fastener. In this way, in addition to standard wiring, it is avoided that the gravity of the connection wire is concentrated at the position where the connection wire is connected to the air conditioner outdoor unit. Moreover, the risk of the disengagement of the connection wire 160 is reduced. It can be understood that the connection wire 160 may be the electrical connection wire 160. The connection wire 160 is fixed after passing through the wire binding hole 123, which improves the electricity safety of the air conditioner while avoids the disengagement of the connection wire 160. Therefore, the stable operation of the air conditioner is ensured.

It should be noted that the number of the wire binding holes 123 may be set as required. In response to having the plurality of connection wires 160 of the air conditioner outdoor unit, the plurality of wire binding holes 123 may be correspondingly formed on the housing 121 to standardize the wiring of the air conditioner outdoor unit. The number of the fasteners has a one-to-one correspondence to the number of the wire binding holes 123. Therefore, in addition to standard wiring, it is avoided that the gravity of the connection wire 160 is concentrated at the position where the connection wire is connected to the air conditioner outdoor unit. In addition, the risk of the disengagement of the connection wire 160 is reduced.

As illustrated in FIG. 1, FIG. 2, FIG. 3, and FIG. 4, on the basis of any one of the above embodiments, further, an outer edge of the water receiving member 120 is bent towards a side facing away from the accommodation cavity 130 to form a mounting portion 124. The water receiving member 120 is disposed on the casing 110 through the mounting portion 124.

In this technical solution, a part of the outer edge of the water receiving member 120 is bent towards the side facing away from the accommodation cavity 130 to form the mounting portion 124. Moreover, the water receiving member 120 is mounted on the casing 110 through the mounting portion 124. By providing the mounting portion 124 to achieve a fixed connection between the water receiving member 120 and the casing 110, it is possible to enhance strength of the connection between the water receiving member 120 and the casing 110 and ensure that the water receiving member 120 can collect the condensate water condensed on the circulation component. Moreover, the water receiving member 120 covers the outer side of the valve body 141. By improving the strength of the connection between the water receiving member 120 and the casing 110, it is also possible to improve a protection effect of the water receiving member 120 on the valve body 141. Moreover, the service life of the valve body 141 is further prolonged.

It can be understood that the mounting portion 124 is a part of the water receiving member 120, i.e., the housing 121 and the mounting portion 124 are integrally formed. It can be understood that the integrated structure has excellent mechanical properties. In this way, strength of a connection between the housing 121 and the mounting portion 124 can be improved. The strength of the connection between the water receiving member 120 and the casing 110 can be further improved. Therefore, it is ensured that the water receiving member 120 can collect the condensate water condensed on the circulation component. In addition, the integrated structure also facilitates the processing and production. Therefore, the processing difficulty of the water receiving member 120 can be reduced. The production efficiency is improved, and the production cost is lowered.

As illustrated in FIG. 1, on the basis of the above embodiments, further, the mounting portion 124 has a plurality of connection holes 125. The air conditioner outdoor unit further includes a plurality of connectors. The plurality of connectors has a one-to-one correspondence to the plurality of connection holes 125.

In this embodiment, it is defined that the mounting portion 124 has the plurality of connection holes 125. In some embodiments, the air conditioner outdoor unit also includes the plurality of connectors having a one-to-one correspondence to the plurality of connection holes 125. The plurality of connectors may pass through the plurality of connection holes 125, which realizes fixed mounting of the water receiving member 120 and the casing 110 through the mounting portion 124. By providing the plurality of connectors having a one-to-one correspondence to the plurality of connection holes 125, it is possible to improve a connection effect between the water receiving member 120 and the casing 110. Moreover, it is ensured that the water receiving member 120 can collect condensate water condensed on the circulation component.

It should be noted that the connection hole 125 may be a threaded hole. The connector may be a screw. The screw passes through the threaded hole to achieve the fixation and mounting of the water receiving member 120 and the casing 110. The fixed connection between the water receiving member 120 and the casing 110 is realized through the screw and the threaded hole, which can improve the connection effect between the water receiving member 120 and the casing 110. Moreover, it is ensured that the water receiving member 120 can collect the condensed water condensed on the circulation component. Moreover, the screw is low in price, which can further lower the production cost of the air conditioner outdoor unit and the production cost of the air conditioner having the air conditioner outdoor unit.

In an exemplary embodiment, further, the partition 150 and the water receiving member 120 are integrally formed.

In this embodiment, it is defined that the partition 150 and the water receiving member 120 are integrally formed. It can be understood that the integrated structure possesses excellent mechanical properties. Therefore, the stability of the partition 150 in the water receiving member 120 can be improved. In this way, the prevention for the insects and rodents can be effectively implemented. In addition, the integrated structure also facilitates the processing and production. Therefore, the processing difficulty of the water receiving member 120 and the partition 150 can be reduced. In addition, the production efficiency is improved, and the production cost is lowered.

According to a second aspect of the present disclosure, provided is an air conditioner, including: the air conditioner outdoor unit provided by any one of the above embodiments. Therefore, the air conditioner has all the beneficial technical effects of the air conditioner outdoor unit provided by any one of the above embodiments, and details are omitted herein.

Further, the air conditioner also includes an air conditioner indoor unit. The air conditioner indoor unit is in communication with a second part of a circulation component of the air conditioner outdoor unit.

The air conditioner provided in the embodiments of the present disclosure includes the air conditioner outdoor unit and the air conditioner indoor unit. In some embodiments, the air conditioner outdoor unit and the air conditioner indoor unit are in communication with each other through the circulation component. In a further embodiment, the circulation component includes the valve body 141 and the pipeline 142. The air conditioner outdoor unit is in communication with the air conditioner indoor unit through the pipeline 142. After the valve body 141 is opened, the closed refrigerant circulation circuit is formed between the air conditioner indoor unit and the air conditioner outdoor unit. The refrigerant circularly flows in the air conditioner indoor unit and the air conditioner outdoor unit, and the refrigerant absorbs heat and releases heat through the change of physical state of the refrigerant. Further, the refrigeration function and heating function of the air conditioner are achieved.

During the refrigerant circulation, due to the low temperature of the refrigerant, the water vapor in the air is easily condensed to form water drops on the circulation component connected to the air conditioner outdoor unit and the device to be communicated. By providing the water receiving member 120 on the casing 110, it is possible to collect the condensate water formed on the circulation component. Moreover, the condensate water is prevented from dripping, and the user experience is enhanced.

In addition, the first part of the circulation component is located in the accommodation cavity 130, i.e., the water receiving member 120 covers the outer side of the first part of the circulation component. In this way, the water receiving member 120 can shield and protect the first part of the circulation component. Therefore, the service life of the circulation component is further prolonged. It can be understood that the circulation component includes the valve body 141 and the pipeline 142. The valve body 141 may be located in the accommodation cavity 130, allowing the water receiving member 120 to shield and protect the valve body 141. In this way, the service life of the valve body 141 can be further prolonged. Moreover, the opening is formed on the water receiving member 120. Therefore, the connection between the pipeline 142 and the valve body 141 is facilitated, making it convenient for the user to maintain or replace the valve body 141 through the opening.

Further, the partition 150 is disposed on the water receiving member 120. Moreover, the accommodation cavity 130 is divided into the first cavity 131 and the second cavity 132 by the partition 150. The first cavity 131 is disposed closer to the opening than the second cavity. The part of the first part of the circulation component is located in the first cavity 131, and the other part of the first part of the circulation component is located in the second cavity 132, i.e., the part of the circulation component located in the accommodation cavity 130 has the part located in the first cavity 131 and the other part located in the second cavity 132. That is, by providing the partition 150 on the water receiving member 120, it is possible to allow the second cavity 132 to form the relatively closed chamber. Therefore, in addition to collecting the condensate water formed on the circulation component, it is possible to effectively prevent the insects and rodents from entering and accumulating in the second cavity 132. In this way, the user experience of the air conditioner is improved.

It should be noted that, the partition 150 and the water receiving member 120 may be integrally formed. It can be understood that the integrated structure possesses excellent mechanical properties. Therefore, the stability of the partition 150 in the water receiving member 120 can be improved. In this way, the prevention for the insects and rodents can be effectively implemented. In addition, the integrated structure also facilitates the processing and production. As a result, the processing difficulty of the water receiving member 120 and the partition 150 can be reduced. In addition, the production efficiency is improved, and the production cost is lowered.

In the description of the specification, terms such as "connect to", "install", "fix", and the like should be understood in a broad sense. For example, "connect to" may be a fixed connection or a detachable connection or connection as one piece; a direct connection or an indirect connection through an intermediate. For those of ordinary skill in the art, the specific meaning of the above terms in the present disclosure should be understood according to specific circumstances.

In the description of this specification, descriptions with reference to the terms "an embodiment", "some embodiments", or "specific examples" mean that specific features, structure, materials or characteristics described in conjunction with the embodiment or example are included in at least one embodiment or example of the present disclosure. In this specification, the schematic representations of the above terms do not necessarily refer to the same embodiment or example. Moreover, the described specific features, structures, materials or characteristics may be combined in any one or more embodiments or examples in a suitable manner.

While preferred embodiments of the present disclosure have been described above, the present disclosure is not limited thereto. For those skilled in the art, various changes and modifications can be made to the present disclosure. Any modification, equivalent replacement, improvement, etc., made within the spirit and principle of the present disclosure shall fall within the scope of the present disclosure.

What is claimed is:

1. An air conditioner outdoor unit comprising:
a casing;
a water receiving member disposed on the casing, the water receiving member having an opening;
an accommodation cavity located between the casing and the water receiving member, the accommodation cavity being in communication with the opening;
a circulation component having a first part located in the accommodation cavity and a second part passing through the opening to be in communication with a device to be communicated; and
a partition disposed in the water receiving member and located in the accommodation cavity, the partition extending away from the casing, the accommodation cavity being divided into a first cavity and a second cavity by the partition, the first cavity being located closer to the opening than the second cavity, a part of the first part of the circulation component being located in the first cavity, and another part of the first part of the circulation component being located in the second cavity.

2. The air conditioner outdoor unit according to claim 1, wherein:
the casing is provided with a compressor;
the first part of the circulation component comprises a valve body having a first end in communication with the compressor; and
the second part of the circulation component comprises a pipeline, the pipeline having a first end in communication with a second end of the valve body and a second end, the second end of the pipeline passing through the opening and being in communication with the device to be communicated,
wherein a part of the valve body is located in the first cavity, and another part of the valve body is located in the second cavity.

3. The air conditioner outdoor unit according to claim 2, wherein the partition comprises:
a body; and
an avoidance opening formed in the body, the first cavity being in communication with the second cavity through the avoidance opening, and a part of the valve body being located in the avoidance opening.

4. The air conditioner outdoor unit according to claim 3, wherein the avoidance opening has a shape corresponding to a shape of the valve body.

5. The air conditioner outdoor unit according to claim 3, wherein a spacing d between a part of the body located in the avoidance opening and the valve body satisfies $d<10$ mm.

6. The air conditioner outdoor unit according to claim 1, wherein the water receiving member further comprises:
a housing having the accommodation cavity; and
a water receiving groove formed at the housing and located in the first cavity, an opening of the water receiving groove facing towards the circulation component.

7. The air conditioner outdoor unit according to claim 6, wherein the water receiving groove is detachably formed on the housing.

8. The air conditioner outdoor unit according to claim 6, wherein:
a side wall of the water receiving groove has a drainage outlet; and
the water receiving member further comprises a plugging member disposed at the housing, the plugging member being configured to open or close the drainage outlet.

9. The air conditioner outdoor unit according to claim 6, further comprising a connection wire connected to the device to be communicated,
wherein the water receiving member further comprises a wire binding hole formed on the housing, the connection wire being capable of passing through the wire binding hole.

10. The air conditioner outdoor unit according to claim 9, wherein the wire binding hole is formed at a side of the housing facing away from the water receiving groove.

11. The air conditioner outdoor unit according to claim 9, further comprising:
a fastener disposed at the water receiving member close to the wire binding hole.

12. The air conditioner outdoor unit according to claim 1, wherein:

an outer edge of the water receiving member is bent towards a side facing away from the accommodation cavity to form a mounting portion; and the water receiving member is disposed on the casing through the mounting portion.

13. The air conditioner outdoor unit according to claim 12, wherein:

the mounting portion has a plurality of connection holes; and the air conditioner outdoor unit further comprises a plurality of connectors having a one-to-one correspondence to the plurality of connection holes.

14. The air conditioner outdoor unit according to claim 1, wherein the partition and the water receiving member are integrally formed.

15. An air conditioner comprising:

the air conditioner outdoor unit according to claim 1; and an air conditioner indoor unit in communication with the second part of the circulation component of the air conditioner outdoor unit.

16. The air conditioner outdoor unit according to claim 1, wherein the partition extends from a wall of the water receiving member opposite the casing to the casing.

17. The air conditioner outdoor unit according to claim 1, wherein:

the opening forms an opening plane; and the partition is substantially parallel to the opening plane.

18. The air conditioner outdoor unit according to claim 12, wherein:

the mounting portion forms a mounting plane; and the partition is substantially perpendicular to the mounting plane.

* * * * *